United States Patent [19]

Bresina et al.

[11] 4,266,868

[45] May 12, 1981

[54] MULTIPLE ROLL DEVELOPING APPARATUS

[75] Inventors: Larry J. Bresina, St. Paul; Richard D. Hipp, Rushseba Township, Chisago County, both of Minn.

[73] Assignee: Minnesota Mining and Manufacturing Company, St. Paul, Minn.

[21] Appl. No.: 58,075

[22] Filed: Jul. 16, 1979

[51] Int. Cl.[3] ..... G03G 15/09

[52] U.S. Cl. ..... 355/3 DD; 118/657

[58] Field of Search ..... 355/3 DD; 118/656, 657, 118/658; 430/122

[56] References Cited

U.S. PATENT DOCUMENTS

| | | | |
|---|---|---|---|
| 3,081,737 | 3/1963 | Frantz et al. | 430/122 X |
| 3,133,834 | 5/1964 | Sowiak | 118/637 |
| 3,392,432 | 7/1968 | Neumann | 29/110 |
| 3,455,276 | 7/1969 | Anderson | 118/637 |
| 3,608,522 | 9/1971 | Davidson | 118/637 |
| 3,638,614 | 2/1972 | Young et al. | 118/637 |
| 3,640,248 | 2/1972 | Nielander | 118/658 |
| 3,703,395 | 11/1972 | Drexler et al. | 118/658 X |
| 3,908,595 | 9/1975 | Okada | 118/637 |
| 3,982,498 | 9/1976 | Wilcox | 118/637 |
| 4,048,957 | 9/1977 | Tagawa | 355/3 DD |
| 4,063,533 | 12/1977 | White | 118/658 |
| 4,068,623 | 1/1978 | O'Toole et al. | 118/658 |
| 4,086,006 | 4/1978 | Hauser et al. | 355/3 DD |
| 4,121,931 | 10/1978 | Nelson | 118/658 |
| 4,131,357 | 12/1978 | Forbes | 355/3 DD |

*Primary Examiner*—William H. Beha, Jr.

*Attorney, Agent, or Firm*—Cruzan Alexander; Donald M. Sell; John C. Barnes

[57] ABSTRACT

An apparatus for applying toner particles to a photoconductive surface having multiple magnetic brushes each of which consists essentially of a magnetic inner shaft and a nonmagnetizeable outer sleeve, with both the sleeve and the inner shaft of each brush being capable of independent rotation. The apparatus uses an adjustably mounted doctor blade to apply toner particles to one of the brushes.

The rotation of the inner shafts and sleeves of the brushes, the spacings between the brushes, as well as the magnetic attraction between the brushes affords the transfer of toner from this first brush to the other brushes. Following the transfer of toner, each brush is able to apply toner to the photoconductive surface.

6 Claims, 2 Drawing Figures

MULTIPLE ROLL DEVELOPING APPARATUS

BACKGROUND OF THE INVENTION

The invention presented herein relates to a multiple roll developing apparatus for use in a high speed copying machine.

1. FIELD OF THE INVENTION

Common to electrographic copying processes is the developing of a photoconductive surface which contains a latent electrical charge pattern, by the application of charged toner particles to this photoconductive surface. Several techniques are employed which can be broadly classified according to whether the toner particles are controllably and effectively charged by tribo electric means, inductive means, or electrostatic means.

Those techniques employing triboelectric means require coarse carrier particles in addition to the fine toner particles. These coarse carrier particles are brought into rubbing contact with the fine toner particles to create a triboelectric charge on each of the particles. Due to the nature of the material used for the toner and the carrier, a different polarity of charge is given to the toner than is given to the carrier. As a result the toner and carrier cling together until the toner is attracted by an electrical pattern present on the photoconductive surface. The extreme frictional forces created by the mechanical brushing action creates contamination of the toner particles resulting in problems with low image fidelity. The technique also requires more operator attention for maintaining a correct ratio of carrier to toner particles.

The other developing techniques generally utilize one-part toner particles. These one-part toner particles can be conductive or non-conductive. If the particles are conductive an electrical circuit can be established through the toner particles so as to induce an electrical charge on their surface. This induced charge can then be attracted by the electrical pattern on the photo conductive surface. With conductive toner particles, the induced charge is able to migrate throughout the particle. This increases the probability that a particle might neutralize or lose its charge. This tendency to quickly lose charge makes it difficult to utilize this technique where it is required to transfer toner particles to a relatively conductive medium such as electrically unstable plain paper. For this reason this technique is generally not applicable to plain paper copiers.

If the particles are non-conductive, it has generally been required to spray them with electrostatically generated ions. These ions could then be attracted to the photoconductive surface and thus cause the toner particles to migrate and attach themselves to this photoconductive surface. The requirement for an ion generating device resulted in greater complexity and larger space requirements. The technique was also prone to non-uniform ion emission causing time-dependent variations in the developed images.

U.S. Pat. No. 4,121,931 (Nelson), which description is hereinafter incorporated by reference, disclosed a novel method of utilizing non-conductive type toners without the need for spraying ions. This technique embodied the discovery that insulating type toner when brought into a rapid, turbulent, physical mixing action in the presence of an electrical field will exhibit charge transport properties similar to toners having several orders of magnitude higher conductivity. The teachings of Nelson enabled an efficient, uniform, and highly reproducible method of charging toner particles which overcame most of the above described deficiencies. The technique used, however, is highly dependent upon maximizing the strength of the electrical field and the amount of mixing action which occurs. The field strength increases as the distance between the photoconductive surface and the transport member for the toner particles decreases, and the mixing action increases as the speed of the transport mechanism for the toner particles increases.

Both of these criteria become difficult to achieve as the speed of the copy machine increases. The faster copying speeds require the toner to be supplied in a shorter period of time. This necessarily increases the speed of the toner transport mechanism. If the transport mechanism is a single roll utilizing magnetic forces to carry magnetically attractable toner particles, a peripheral speed can be reached where the centrifugal force of the toner particles due to the roll rotation exceeds the magnetic force causing the particles to adhere to the roll. This obviously causes handling problems.

Thus, although the Nelson teachings were a great advancement within the art as far as the mechanism for charging one part insulating toner, they did not specifically deal with the problem of supplying and handling the toner particles at high copying speeds.

SUMMARY OF THE INVENTION

The present invention embodies the discovery of a novel means to overcome the roll speed limitations of high-speed copying through the use of multiple developing rolls, without adding a lot of complexity, and without sacrificing the quality possible with insulated one-part toners. It does this by precisely controlling the toner applied to a single developing roll, and by precisely subdividing that toner among the various other developing rolls of the developing assembly, with each roll individually applying toner to the photoconductive surface.

The developing rolls are formed from a number of generally sector-shaped magnetic members arranged in a circular array around a center shaft, thus forming a magnetic shaft. These magnetic members are similar in construction to those described in U.S. Pat. No. 3,455,276, which description is incorporated herein by reference. It should be noted that it is feasible to operate this invention with other magnetic structures as long as a relatively uniform magnetic field can be achieved over the length of the developing roll. The magnetic shaft is encased by a cylindrical sleeve formed from a nonmagnetizable material. Both the sleeve and the shaft are individually rotatably amounted in relation to the photoconductive surface.

One of the developing rolls is positioned such that toner can be metered onto it by an adjustably mounted doctor blade from an adjacent reservoir of toner particles. These toner particles are attracted by the magnetic force of the developing roll and thus attach themselves to the exterior surface of the sleeve of the developing roll. The magnetic shaft, and/or the sleeve of the developing roll is driven, tumbling and toner under the effects of the changing magnetic field, and advancing it to a position where the developing roll forms an elongate nip area with an adjacent developing roll. At this position the magnetic force of the second developing roll will attract a portion of the toner particles on the first developing roll and cause them to leave the first roll and attach themselves to the second developing roll. The magnetic shaft and/or sleeve of the second developing roll is also driven and will continue the advance of the toner particles by the same method to any other developing rolls used.

The portion of the toner which is not attracted by an adjacent developing roll continues to advance until it reaches a position proximate to the photoconductive surface. Portions of this toner can transfer to the photoconductive surface by a process described by Nelson previously cited and incorporated.

Any toner which is transferred to the photoconductive surface will be replenished by the same means in which it was initially transferred to the developing roll.

Since this invention is capable of utilizing one-component insulated toner particles and the techniques taught by Nelson to attach these particles to the photoconductive surface it is able to overcome the deficiencies previously described. It is also able to control these techniques at higher copying speeds by its precise control and division of the toner particles and its use of a single adjustable doctor blade to meter the toner particles over multiple developing rolls.

DESCRIPTION OF THE ACCOMPANYING DRAWINGS

For a more complete understanding of the invention reference should be made to the accompanying drawings wherein like elements in each of the several figures are identified by the same reference characters, and wherein.

DETAILED DESCRIPTION OF THE PREFERRED EMBODIMENT

Figure 1:
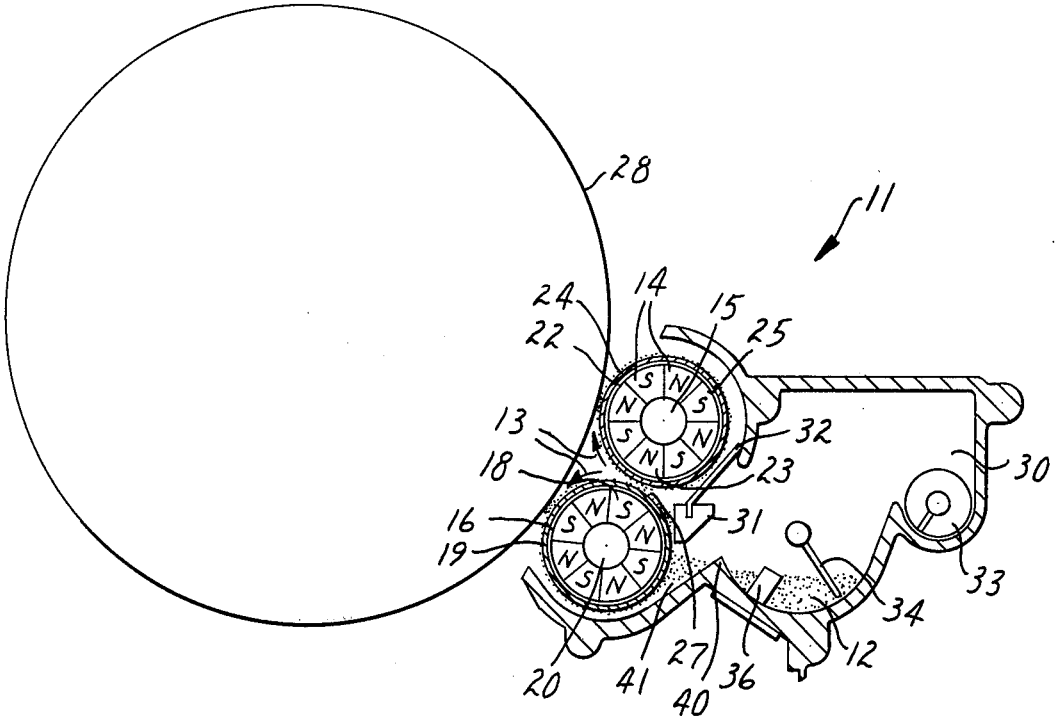
FIG. 1 is a schematic vertical-sectional view of this invention.
Figure 2:
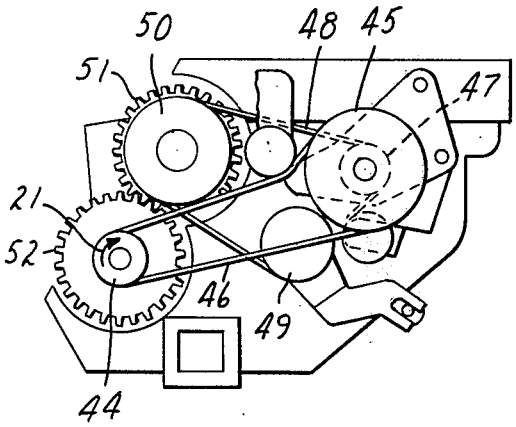
FIG. 2 is a side view of this invention showing the gearing arrangement.

A developing apparatus 11 is illustrated comprising a lower developing roll 16, an upper developing roll 22, an adjustable doctor blade 31, and means defining a reservoir 30 containing toner particles 12.

The toner particles 12 are brought into the reservoir 30 by means of a toner auger 33 from an exterior container, not shown. A sensor 36 working in combination with a bail 34 indicate when the toner within the reservoir is in a low condition. The bail 34 also has the function of agitating the toner particles 12 and propelling them forward over a separator 40 into depression 41. Affixed in the vicinity of depression 41 is the lower developing roll 16. It is disposed such that its shell is lower than the depression separator 40, thus allowing it to be partially submerged in toner particles 12.

The developing rolls 16 and 22 are alike and each consist of a central shaft 15 upon which are affixed sector-shaped magnetic members 14 so as to form a circular array around the central shaft 15. This combination is referred to generally as a magnetic shaft 20 or 25. A thin wall annular-shaped sleeve 19 or 24 formed from a nonmagnetizable material is positioned around and proximate to the magnetic shaft 20 or 25. Although this embodiment illustrates the magnetic members 14 being adjacent to each other and with alternating poles, it is noted that the invention will function with discrete spaces between the magnetic members 14 and with certain adjacent magnetic members 14 being of like polarity. This is true as long as the magnetic members 14 on opposite sides of the nip area 27 are of opposite polarity as illustrated by the south pole 18 of the lower developing roll 16 and the north pole 23 of the upper developing roll 22. Adjacent to the lower developing roll 16 is a doctor blade 31 which is adjustably mounted in the developing apparatus 11. A plastic separator 32 connected to the doctor blade 31, separate the area in which the developing rolls are housed from the reservoir area.

The transport of toner 12, requires the rotation of the developing rolls 16 and 22. To accomplish this the magnetic shafts 20 and 25, and the outer sleeves 19 and 24 are separately journalized with appropriate bearing means (not shown). A suitable prime mover (also not shown) drives a main drive gear 44, which is affixed to one end of the magnetic shaft 20 of the lower developing roll 16. The movement of the main drive gear 44 and its associated magnetic shaft 20 in a clockwise direction, as indicated by arrow 21, sets up a rotating magnetic field about the magnetic shaft 20. The magnetic shaft 25 of the upper developing roll 22 encounters this rotating magnetic field and is induced to move in an opposite direction due to the interaction of its magnetic poles with those of the driven lower magnetic shaft 20. This causes a counter-clockwise rotation of the upper magnetic shaft 25. The main drive gear 44 is in turn connected to a larger diameter first idler gear 45 via a first timing belt 46. This first idler gear 45 is coaxially connected to a smaller diameter second idler gear 47 which is in turn connected via a second timing belt 48 to a bail drive gear 49 and an upper sleeve drive gear 50. This dual step-up and the use of idler gears 45 and 47 allow a speed reduction within the confines of the developing apparatus without the need for larger gear ratios and longer timing belts which are physically undesirable. The bail drive gear 49 is affixed to a harmonic speed reduction unit (not shown) upon which bail 34 is fastened. The upper sleeve drive gear 50 is affixed to the sleeve 24 of the upper developing roll 22. Finally coaxial to the upper sleeve drive gear 50 is cluster gear 51 which engages cluster gear 52, affixed to the sleeve 19 of the lower developing roll 16. This gearing arrangement affords rotation of the sleeves 19 and 24 in the directions indicated by arrow 13.

Thus, rotation of the main drive gear 44 directly drives the magnetic shaft 20 of the lower developing roll 16 which in turn magnetically drives the magnetic shaft 25 of the upper developing roll 22. The rotation of the main drive gear 44 also drives the reservoir bail 34 and the upper and lower sleeves 19 and 24 of the developing roll 16 and 22 through the associated idler gears 45 and 47, timing belts 46 and 48, cluster gears 51 and 52, and drive gears 49 and 50. With this drive means counter-rotation of the magnetic sleeves 19 and 24 can be achieved concurrently with counter-rotation of the magnetic shafts 20 and 25.

Having given a description of the preferred embodiment it should be mentioned that the use of separately journalized shafts and sleeves as well as the use of separate drive gears for each of the shafts and sleeves facilitates the ability to drive each of these components separately. Although the present invention as currently used does not require this separate drive capability it is feasible without major modification.

In operation toner particles 12 are attracted to the lower developing roll 16, and as the sleeve 19 or shaft 20 of lower developing roll 16 rotates, the particles advance in the direction indicated by arrow 13, to the doctor blade 31 and are metered by the doctor blade 31 to a desired thickness. A workable gap between the doctor blade 31 and the lower developing roll 16 is 0.011 inch. The toner particles 12 permitted to pass between the doctor blade 31 and the lower developing roll 16 continue toward the nip area 27 created between the upper developing roll 22 and the lower developing roll 16. A gap of 0.062 inch has been used for the spacing within this nip area. Upon approaching the nip area 27 the toner particles 12 come within the influence of the magnetic field of the upper developing roll 22. By way of example the north pole of magnetic member 23 attracts some of the toner particles toward the upper developing roll 22 and the toner particles 12 tend to divide between the two developing rolls 16 and 22, with a portion of the toner particles 12 previously on lower developing roll 16 transferring to the upper developing roll 22. This division is related to the magnetic pole strength of the developing rolls, which in the embodiment illustrated is equal and in the range of 750–800 gauss, and the gap between the developing rolls 16 and 22.

The accurate spacing between developing rolls and the linearity and accurate control of the magnetic pole strength results in precise and repeatable division of the toner particles between the two developing rolls and the resulting transfer of a portion of the toner particles 12 from lower developing roll 16 to upper developing roll 22. The toner particles 12 continue to advance around the developing rolls 16 and 22 in a direction indicated by arrows 13 until they contact the photoconductive surface 28, by the method described in Nelson, previously cited. In the preferred embodiment the distance between the photoconductive surface 28 and the developing rolls 16 and 22 is in the range of 0.017–0.022 inch. Those toner particles 12 remaining on the developing rolls 16 and 22 will continue to advance in the direction of arrow 13. Toner particles 12 which were transferred to photoconductive surface 28 will replenished in the same manner they were initially transferred to the developing rolls 16 and 22.

Having thus described a preferred embodiment of the present invention it will be understood that changes may be made in size, shape, or configuration of some of the parts without departing from the present invention as described in the appended claims.

What is claimed:

1. An improved developing apparatus for applying one-part toner particles to a photoconductive surface in a copy machine, said apparatus comprising A. a plurality of magnetic brushes arranged in a parallel spaced relationship so as to form an elongate nip area at their proximate surface, each of said brushes comprises
   1. a magnetic shaft having poles arranged in a spaced relationship so as to form a circular array about said shaft,
   2. a thin walled annular-shaped sleeve formed of nonmagnetizable material positioned around and proximate said magnetic shaft, and
   3. means for mounting said magnetic shaft and said sleeve of said brush for relative rotational movement, B. means for supplying toner particles to said brushes including means defining a reservior for said toner particles and an adjustably-mounted doctor blade disposed between said reservoir and one of said brushes to control the amount of powder carried by said one of said brushes, and C. drive means affording relative rotation of said magnetic shafts and said sleeves to advance said toner particles from said doctor blade toward said nip area between said brushes so as to divide said toner particles at said nip area and transfer a portion of said toner particles to an adjacent brush and direct said toner particles on said brushes toward said photoconductor.

2. An apparatus as claimed in claim 1 wherein said drive means includes means to rotate said magnetic shafts and said sleeves.

3. An apparatus as claimed in claim 1 having a pair of said magnetic brushes wherein said drive means includes means to rotate said sleeves in opposite directions.

4. An apparatus as claimed in claim 1 having a pair of said magnetic brushes wherein said drive means includes means to rotate said magnetic shafts in opposite directions.

5. An apparatus as claimed in claim 1 or 4 wherein one of said magnetic shafts is directly coupled to said drive means, whereby the rotation of said one of said magnetic shafts provides a rotating magnetic field to inductively couple an adjacent magnetic shaft so as to cause said adjacent magnetic shaft to rotate.

6. An apparatus as claimed in claim 1 wherein at least one of said plurality of said magnetic brushes has a different magnetic field strength than another of said magnetic brushes.

* * * * *